United States Patent [19]

DuBois

[11] Patent Number: 4,717,151

[45] Date of Patent: Jan. 5, 1988

[54] GRIP FOR GAME RACQUETS

[76] Inventor: Craig R. DuBois, 601 E. San Antonio, Suite 203, Victoria, Tex. 77901

[21] Appl. No.: 893,983

[22] Filed: Aug. 7, 1986

[51] Int. Cl.[4] ..... A63B 49/00

[52] U.S. Cl. ..... 273/75; 273/73 J; 273/81.4

[58] Field of Search ..... 273/75, 73 J, 81.4

[56] References Cited

U.S. PATENT DOCUMENTS

| | | | |
|---|---|---|---|
| 259,448 | 6/1882 | Woodhouse | 273/75 |
| 412,479 | 10/1889 | Davis | 273/75 |
| 3,868,110 | 2/1975 | Jones | 273/75 |
| 3,905,598 | 9/1975 | Ballog | 273/75 |
| 4,006,896 | 2/1977 | Soldavini | 273/75 X |
| 4,470,599 | 9/1984 | Usher, Jr. | 273/75 |
| 4,617,697 | 10/1986 | David | 273/75 X |

FOREIGN PATENT DOCUMENTS

| | | | |
|---|---|---|---|
| 2746168 | 4/1970 | Fed. Rep. of Germany | 273/75 |
| 3414293 | 10/1985 | Fed. Rep. of Germany | 273/75 |
| 2232337 | 1/1975 | France | 273/75 |
| 211792 | 2/1924 | United Kingdom | 273/75 |

*Primary Examiner*—Randolph A. Reese
*Assistant Examiner*—Joseph A. Fischetti
*Attorney, Agent, or Firm*—Gunn, Lee & Jackson

[57] ABSTRACT

A handle design for game racquets such as tennis, racquetball, squash, etc. which handle is contoured to produce a more balanced use of the two main groups of forearm flexors and the hand muscles so as to minimize tendonitis and bursitis in the elbow and shoulder of the user. The handle is contoured on three of its sides by providing concavities to accommodate the region of the hand known as the hypothenar eminence and to accommodate the shorter second and fifth digits.

1 Claim, 4 Drawing Figures

GRIP FOR GAME RACQUETS

BACKGROUND OF THE INVENTION

The current shape of all standard racquet handles is uniform from the proximal to the distal aspects of the grip surface. When configured in this fashion, the circumferential size of the grip may be too large for one part of the hand and yet simultaneously too small for another part, while being "correct" for only a small portion of the hand. When used in this standard configuration there is one portion of the gripping surface that is too small for optimal grip force capacity, due to the greater dimension of the longer middle fingers of the human hand. As such, effectively this "small" sized grip does not allow the user to deliver the maximal amount of the power the muscles are capable of producing. However, it does provide improved control of the racquet by providing a circumferential, enveloping grip by the hand. This is in contrast to using a racquet that is large enough for the greatest dimension of the hand, where, due to the smaller dimensions of the index and little fingers, there is likewise a portion of the grip that is "too large". As related to the "anatomical size" of the user's hand, the "too large" portion of the racquet head occurs near the end of the handle where the small fingers are too short. The "too small" portion exits at the middle and forward end of the grip surface which is enveloped by the longest finger. In the standard configuration the maximal grip force obtainable for the smallest portion of the hand may be suboptimal. This results in an inequality in the optimal forces obtainable by the user from the different parts of the hand.

Such inequalities in forces applied on the racquet may result in the hand not being able to adequately prevent twisting or loss of control of the racquet when a ball is hit off center or in an undesirable fashion. There unequal forces are applied in differential fashion to the muscles on either side of the forearm of the radial (lateral) aspect of the hand as compared to the ulnar (medial) aspect of the hand. This is due, at least in part, to the unbalanced forces exerted by flexor carpi radialis on the lateral aspect of the forearm and the flexor carpi unlaris muscles along the medial aspect of the forearm. The current design of the hands or grips on racquets produces unbalanced forces on the hand and forearm when a ball is struck.

In a well developed athlete, the strength of the normal hand muscles are able to compensate for the mechanical disadvantage placed upon these muscles by the demands of the object they are gripping, such as a racquet. The forearm muscles exert considerable force in the function of gripping, and they act in conjunction with the intrinsic hand muscles. However, if there exists an inequality of the intrinsic hand muscles, there is typically also an inequality of the forearm muscles since there must be a concerted action between both sets of muscles. In an attempt to rectify this inequality of use, there may develop subsequent muscular hypertrophy resulting in a gain in contractile effort (or "power" capacity) of selected groups of muscles. This hypertrophy allows the user to manipulate inefficiency with brute muscular force, but unfortunately may lead to even greater hypertrophy. Whenever there is an inequality of strength and power of antagonistic muscles operating across a common joint, a high likelihood of muscular and ligamentous strain can occur.

Thus, when there is repeated inequality in the utilization of the flexor bundles, tendonitis and/or bursitis is quite likely to develop in the muscle group that is under the greater strain. Persons who play racquet sports such as tennis, racquetball, and squash frequently develop bursitis or tendonitis in their joints, especially at the elbow. The exact cause of "tennis elbow" as this infirmity is commonly called, is not completely known, but one major factor is the inefficient use of complimentary, or agonistic, muscles which leads to unequal force exertion and excessive strain across the joints subserved by the muscle groups involved.

The design of the racquet handle of the invention should minimize the occurrence of this malady since the design of the invention will produce a more equal and balanced use of the two main groups of forearm flexors and of the intrinsic hand muscles.

SUMMARY OF THE INVENTION

The optimum situation is to custom-fit each racquet to the user's hand, but this is impractical from a cost standpoint and would not permit the user to change his or her grip for different strokes used during play. Although a precise fit to the hand of the racquet user is not necessary, the closer the fit, the more the forces will be equalized on the hand and forearm. Therefore, it is the principal object of the invention to design a racquet handle and grip that approaches the optimal situation of a custom fit while permitting a standardized grip to be used, thus minimizing the likelihood of a player developing tendonitis or bursitis.

The racquet handle of the invention is provided with an area near the end of the handle that is narrowed by a concave cut on two opposite sides of the handle, one larger than the other. The larger cut is designed to accommodate the hypothenar eminence and the smaller to accommodate the terminal digit of the smallest finger, and in some hands the fourth finger will fit as well. The handle is also provided with a similar concavity on that portion of the handle that is transverse to the sides where the handle is narrowed, with this concavity being so produced as to provide space for the proximal phalanx of the small or fifth finger. These properly placed concavities in the handle of the racquet will tend to substantially equalize the forces applied to the muscles of the hand and forearm.

DESCRIPTION OF THE PREFERRED EMBODIMENT OF THE INVENTION

Figure 1:
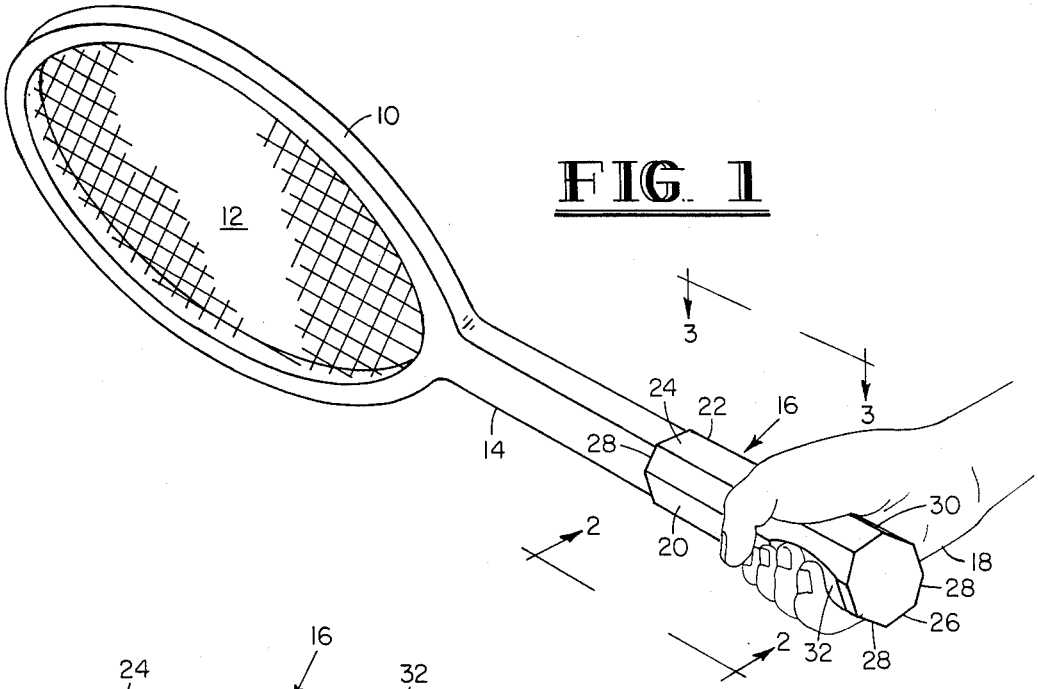
FIG. 1 is a perspective view of a tennis racquet and illustrates a handle with a grip designed according to the principles of the invention.
Figure 2:
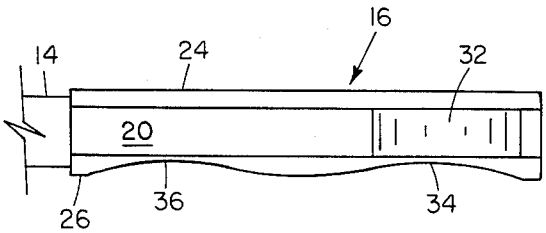
FIG. 2 is an elevational view of the handle portion of the racquet of FIG. 1 when that portion is viewed in the direction indicated by the Lines 2—2 of FIG. 1.
Figure 3:
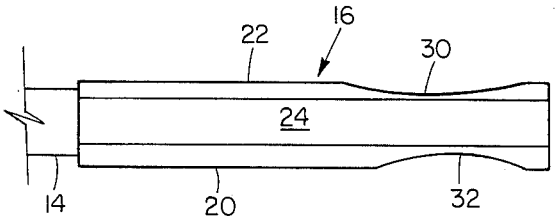
FIG. 3 is an elevational view which shows the handle portion of the racquet of FIG. 1 when viewed in the direction indicated by the Lines 3—3 of FIG. 1.
Figure 4:
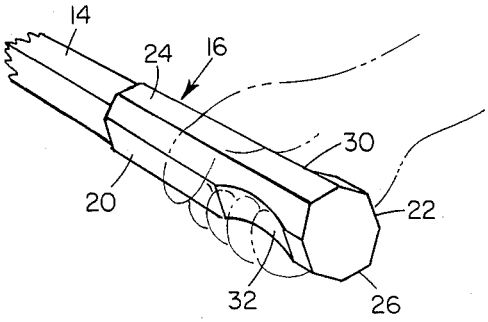
FIG. 4 is a perspective view of the handle portion of the racquet of FIG. 1 showing the hand in phantom to better illustrate the design of the handle.

Referring to FIG. 1, there is illustrated a tennis racquet which has a head frame 10 that holds the strings 12 in a common plane. Connected to the head frame 10 is a handle 14 that extends in the plane of the strings 12 and terminates in a grip 16 that is normally covered with leather or some other suitable material so as to provide a soft, nonslip surface for the hand 18 of the user.

The grip portion 16 of the racquet that is illustrated in the preferred embodiment is octagonal in cross section. The grip portion 16 therefore has two opposite sides 20 and 22 which are parallel to each other and parallel to the plane of the strings 12. Sides 24 and 26 are also spaced apart and parallel to each other and are in planes that are perpendicular to the plane of the strings 12. Sides 20, 22, 24 and 26 are joined by sides 28 to complete the octagonal shape of the handle. Although an octagonal shape is shown for purposes of illustration of the preferred embodiment, since this is a commonly shaped grip for tennis racquets, the principles of the invention are clearly applicable to grips of any cross sectional shape whether they be round, oval or of any other shape.

On side 22 there is formed near the end of the grip 16 a concavity 30 for receiving the hypothenar eminence of the hand 18. On the opposite side 20, there is a concavity 32 that is slightly smaller than concavity 30 into which concavity the terminal digit, which is the smallest digit, is received. Also, the fourth or ring digit is also received in this concavity 32. On the side 26, there is formed near the end of the grip 16 a concavity 34 to provide space for and receive the proximal phalanx of the terminal or smaller digit. A second, less prominent, cancavity 36 is also formed on the side 26 of the grip 16 to accommodate the proximal phalanx of the index finger.

The foregoing described design is based upon the principle that the ulnar and medial aspects of the human hand and forearm do not grip with equal force in an isometric contraction around the circumference of an object that is of uniform dimension throughout its length, such as the standard racquet handle. In the handle design described herein, the concavities 30, 32, 34 and 36 compensate for this inequality and thereby take advantage of the total strength available in the hand. Another factor that is quite important is that the inequality of the contractile effort of the ulnar and medial aspects of the hand muscles is also present in the muscles of the forearm. The forearm muscles exert considerable force in the function of gripping, and they act together with the intrinsic hand muscles. Consequently, if there exists an inequality of the intrinsic hand muscles, there is typically also an inequality of the forearm muscles since there must be a concerted action between both sets of muscles. Because of this inequality of use, there may develop subsequent muscular hypertrophy resulting in a gain in contractile effort or power capacity of selected groups of muscles. This would normally occur in the medial group of the flexor muscles of the forearm. Whenever there is an inequality of strength and power of antagonistic muscles operating across a common joint, a high likelihood of muscular and ligmentous strain can occur. Thus, when there is repeated inequality in the utilization of the flexor bundles, tendonitis and/or bursitis is quite likely to develop in the muscle group that is under the greater strain. The design of the racquet handle of the invention should minimize the occurrence of this malady since the design of the invention will produce a more equal and balanced use of the two main groups of forearm flexors and of the intrinsic hand muscles.

In the invention, concavities 32 and 34 allow for the fact that the second and fifth fingers are shorter in length than the other fingers which limits their circumferential grip capacity. Thus, by accommodating these differences in the physical structure of the hand, a more balanced and equal use of the muscles of the forearm and hand results. In this manner the racquet handle design will minimize tendonitis and/or bursitis that frequently results when the standard racquet handle design is used. It should be noted that the concavities formed in the grip portion 16 of the handle 14 are superior to placing individual finger grips, since the smooth taper of the concavities provide for hands of different sizes as well as providing for fine adjustments to be made by the individual using the racquet. In other words, the concavities allow the user to find just the right degree of concavity for that particular individual's anatomy. It is also of importance that the concavities allow a comfortable shift by the user from a forehand to a backhand grip as well as any other modified grips developed by that particular user. With most users, very little adaptation is necessary to adapt to the feel of the placements using the racquet handle of the invention. In fact, studies up to this point suggest that the backhand grip is benefitted more than the forehand grip in terms of resistance to twisting or shearing forces. Moreover, it appears that both the forehand and backhand grips will be more powerful than with conventional racquet handles.

Although there is a slight alteration in the position and angle of attack of the racquet head when using the handle design of the invention as compared to a conventional racquet handle, this should not affect the strokes of the user, and in preliminary studies, instances of exceptionally rapid improvement of ground strokes has been noted with use of this invention. The slight elevation of the racquet head is due to the concavities formed in the surfaces 26 and 24, and also appears beneficial to one's strokes.

The only disadvantage, if any, when using a racquet that employs a handle constructed according to the invention, is that the racquet must always be held with the same side forward due to the assymetric nature of the concavities. However, this has not yet proven to be a cause of excessive or premature string wear, or racket frame failure.

Having thus described the preferred embodiment of the invention, it will be evident to those skilled in the art that various revisions and modifications can be made in the particular design disclosed in the preferred embodiment without departing from the spirit and scope of the invention. Obviously, minor variations in the shape, absolute and relative size, and placement of the concavities might be made. It is my intention, however, that all such revisions and modifications will be included within the scope of the following claims.

What is claimed is:

1. A tennis racquet handle for accommodating anatomically related size differentiations in a human hand while hitting a tennis ball with strings in the tennis racquet comprising:

a grip portion being generally octagonal in shape and terminating in a generally perpendicular end;

first and second sides of said grip portion being spaced apart and parallel to each other and parallel to said strings;

third and fourth sides of said grip portion being spread apart and parallel to each other and perpendicular to said strings, said first, second, third, and fourth sides being joined by corner sides to form said generally octagonal shape;

a first concavity being formed in said second side near said perpendicular end to receive the hypothenar eminence of said hand;

a second concavity being formed in said first side near said perpendicular end to receive at least both the terminal digit and the fourth digit of said hand therein, said second concavity being slightly smaller than said first concavity;

a third concavity being formed in said fourth side near said perpendicular end to receive the proximal phalanx of the terminal digit of said human hand; and a fourth concavity being formed in said fourth side to receive the proximal phalanx of the index finger of said human hand, said fourth concavity being spaced away from said perpendicular end toward said strings, said fourth concavity being less prominent than said third concavity;

said first, second, third, and fourth concavities having generally smooth tapers thereby allowing for (a) fine adjustments related to said differentiations in said human hand and (b) a comfortable shift of said human hand from a forehand grip to a backhand grip as well as other modified grip developed by that particular user;

said grip having no concavities other than said first, second, third, and fourth concavities.

* * * * *